United States Patent [19]

Stanger et al.

[11] 4,068,913

[45] Jan. 17, 1978

[54] ELECTRICAL CONNECTOR APPARATUS

[75] Inventors: Robert J. Stanger, Alpha; Larry N. Siebens, Great Meadows, both of N.J.

[73] Assignee: Amerace Corporation, New York, N.Y.

[21] Appl. No.: 740,074

[22] Filed: Nov. 8, 1976

Related U.S. Application Data

[63] Continuation of Ser. No. 610,049, Sept. 3, 1975, abandoned, which is a continuation-in-part of Ser. No. 406,281, Oct. 15, 1973.

[51] Int. Cl.[2] ..... H01R 13/20

[52] U.S. Cl. ..... 339/111; 200/144 C; 339/46; 339/94 R; 339/117 R; 339/143 R

[58] Field of Search ..... 339/111, 45, 46, 60 C, 339/60 R, 94 R, 94 C, 117 R, 143 R; 200/144 C, 149 A, 151

[56] References Cited

U.S. PATENT DOCUMENTS

| | | | |
|---|---|---|---|
| 969,787 | 9/1910 | Leppert | 339/46 |
| 1,736,887 | 11/1929 | Pritchett | 339/46 |
| 3,542,986 | 11/1970 | Kotski | 200/151 X |
| 3,792,215 | 2/1974 | Keto | 200/144 C |

*Primary Examiner*—Roy Lake
*Assistant Examiner*—DeWalden W. Jones
*Attorney, Agent, or Firm*—S. Michael Bender; Richard A. Craig

[57] ABSTRACT

Apparatus for connecting and disconnecting a male contact element and a high voltage cable includes a housing securable to the cable and defining an axial passage having a cavity, a piston assembly with a female contact element movable in the passage and defining a chamber, material generating arc-quenching gas, a gas-pressure responsive valve providing communication between the chamber and cavity selectively on fault closure to accelerate engagement of the contact elements and connectors for providing continuous electrical connection to the female contact element of substantially fixed resistivity.

10 Claims, 6 Drawing Figures

ELECTRICAL CONNECTOR APPARATUS

This is a continuation of application Ser. No. 610,049, filed Sept. 3, 1975, now abandoned which is a continuation-in-part of application Ser. No. 406,281, filed Oct. 15, 1973.

FIELD OF THE INVENTION

This invention relates generally to high voltage power distribution systems and more particularly to connector apparatus for providing separable interconnection of electrical cables of these systems.

BACKGROUND OF THE INVENTION

Three situations are typically encountered in the connection and disconnection of electrical connectors in power distribution systems. The so-called "loadmake" situation involves the joinder of male and female contact elements, one energized and the other engaged with a normal load. An arc of moderate intensity is struck between the contact elements as they approach one another and until joinder. The so-called "loadbreak" situation involves the separation of such mated male and female contact elements, while they supply power to a normal load. Moderate intensity arcing again occurs between the contact elements from the point of separation thereof until they are somewhat removed from one another. The so-called "fault closure" situation involves the joinder of male and female contact elements, one energized and the other engaged with a load having a fault, e.g., a short circuit condition. Quite substantial arcing occurs between the contact elements as they approach one another and until joinder, giving rise to the possibility of explosion and accompanying hazard to operating personnel.

Prior art efforts have reached a point wherein arcing in the loadmake and loadbreak situations is accommodated to more than a satisfactory extent. Thus, connector assemblies in wide-spread use employ materials which emit arc-quenching gas when subjected to arcing, thereby adequately dissipating the moderate intensity arcs occurring in these situations. Arcing in the load-break situation may be accommodated even further by connector assembly structure providing for operator movement of the contact elements, while mated, until the female contact element abuts against a stop member and the male contact element separates therefrom at high velocity as disclosed in Rueffer U.S. Pat. No. 3,259,726 and Kotski U.S. Pat. No. 3,542,986.

Devices not employing the above-mentioned high velocity contact separating structure for loadbreak accommodation, but suited for use in all three situations are shown in Ruete et al. U.S. Pat. No. 3,539,972 and Brown U.S. Pat. No. 3,654,590, commonly-assigned herewith.

As respects the fault closure situation, certain prior art efforts have looked to the use of the aforementioned arc-quenching gas for assistance in accelerating contact elements into engagement. While such prior art gas-assisted contact element engagement efforts have proved advantageous, need exists for continued improvement in connectors relying on arc-quenching gas-assistance in accommodating the fault closure situation through accelerated contact element engagement. Those prior art measures involving arc-quenching gas-assisted contact element movement are now discussed with particularity.

In Whitney U.S. Pat. No. 1,955,215 and in the above-mentioned Kotski U.S. Pat. No. 3,542,986, male and female contact elements having an arc-quenching guide in the latter patent, are joined in accelerated manner by the assistance of gas pressures attending arcing. In these efforts, an open-ended female contact element is supported by an open-ended piston movable in an axial passage in the connector housing. Arc-quenching gas is said to be conducted, without restriction, through the female contact element to exert net pressure on the piston. The piston and hence the female contact element are accordingly displaced in the direction of the male contact element, facilitating joinder more rapidly than would otherwise occur in the absence of such displacement. In freely conducting arc-quenching gas throughout the continuous volume of a female contact and a piston, these prior art efforts effect fault closure at the cost of less than desired loadbreak performance, since in loadbreak performance, it is desirable that the arc-quenching gas be restricted to a confined volume to facilitate containment of such conductive gas in the contact region upon contact separation.

In still another arrangement in present use and described in Joy Manufacturing Company Bulletin 215-4, January 1972, a connector housing includes an axial passage and fixedly supports therein a female contact element defining a chamber for receiving arc-quenching gas. The housing defines a cavity and includes a valve closing one end of the female contact element and thereby separating the female contact element chamber from the housing cavity. A piston disposed in the housing passage encircles the fixed female contact element and is in sliding engagement therewith. The piston supports an arc-quenching guide and a ring-shaped contact element for joint movement therewith. The ring-shaped contact element engages the male contact element on its insertion in the housing at a time prior to joinder thereof with the fixed female contact element. Arc-quenching gas generated by the arc struck between such ring contact and the male contact element during fault closure is conducted into the fixed female contact element chamber and operates the valve, the gas thereupon entering the cavity and moving the piston toward the male contact element. Prior to ultimate engagement of the male and female contact elements, fault current flows through the ring-shaped contact element and is transferred to the female contact element through sliding frictional engagement thereof with the piston. This arrangement is less than desirable in that circuit resistance varies widely during fault closure due to its dependence on indeterminate sliding frictional engagement between the piston and the female contact element surfaces. Furthermore, since the female contact element is fixed in the housing, and since the ring-shaped contact element does not frictionally engage the male contact element, this Joy device does not involve the aforementioned Rueffer patent loadbreak assist, and accordingly effects accelerated fault closure at the cost of less than desired loadbreak performance.

SUMMARY OF THE INVENTION

An object of the present invention is to provide connector apparatus for use in loadmake, loadbreak and fault closure situations and which is adaptive in its operation to individually cerve the needs of each situation.

Toward the attainment of this and other objects, the invention provides connector apparatus incorporating a housing having opposed ends and an axial passage therebetween, means defining a cavity in said passage, a piston assembly disposed in said passage and comprising an arc-quenching guide, a female contact element having a chamber into which arc-quenching gas is directed, a piston supporting the guide and the female contact element for joint movement and gas-pressure responsive valve means for separating the female contact element and the housing cavity and operable to selectively move the piston assembly to accelerate contact element joinder in fault closure situations, and means providing continuous electrical connection to the female contact element of substantially fixed resistivity.

As contrasted with the various functional capabilities provided separately or in limited groupings in the prior art connector apparatus discussed above, the above-summarized and other apparatus according with the invention provides these and other capabilities compositively. Such apparatus provides for preselected positioning of its movable female contact element for assisting loadmake, a degree of freedom of movement for said female contact element for movement thereof while mated with a male connector and gas confinement capacity in said female contact element to enhance loadbreak, and selective gas-assisted movement of said female contact element while providing invariant electrical continuity thereto, thus facilitating fault closure.

The foregoing and other objects and features of the invention will be evident from the following detailed discussion of preferred embodiments thereof and from the drawings wherein like reference numerals identify like parts throughout.

DESCRIPTION OF PREFERRED EMBODIMENTS

Figure 1:
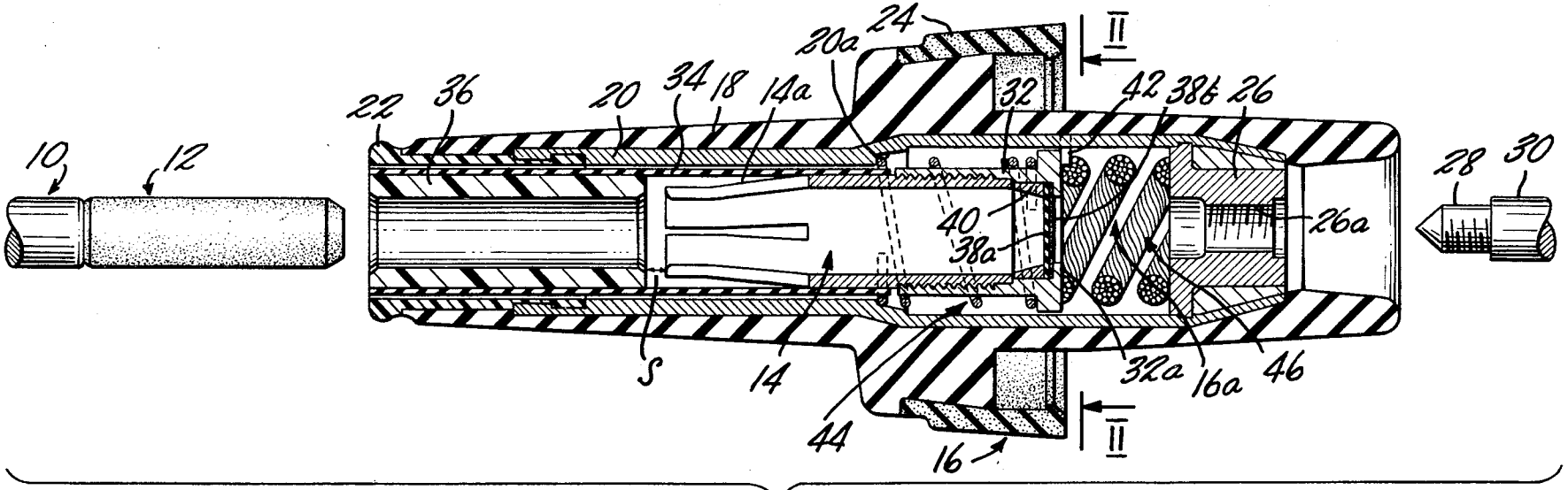
FIG. 1 is a side elevation in full cross-section of connector apparatus in accordance with the invention, shown with a male contact element and high voltage cable separably connected thereby.
Figure 2:
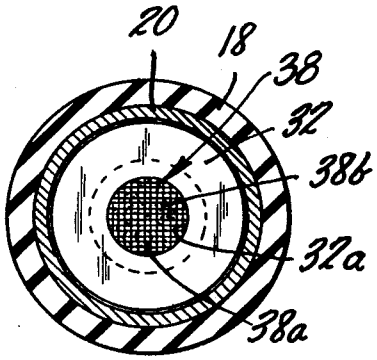
FIG. 2 is a view taken along line II—II of FIG. 1, illustrating one type of valve employable in practicing the invention.

Referring to FIGS. 1 and 2 pin-shaped male contact element 10 is connected through a suitable connector housing to a high voltage electrical conductor (not shown) and supports a follower 12 fabricated of a material suitable for evolving or generating an arc-quenching gas upon being subjected to arcing. A female contact element 14 includes resilient fingers 14*a* for facilitating gripping joinder thereof with contact element 10, attainable following insertion of follower 12 into composite housing 16. Housing 16 defines an axial opening or passage between its opposed ends and includes an outer member or casing 18 preferably formed of elastomeric insulative material, an inner member or sleeve 20 and an insulative insert 22 interlatched with sleeve 20 as shown. Sleeve 20 is comprised of rigid conductive material, e.g., aluminum, and defines a region of uniform electrical potential interiorly of casing 18. Casing 18 may include a sleeve 24 preferably of conductive elastomeric material molded to the exterior of the casing as generally indicated for establishing a shield at the same electrical potential as supporting structure, such as a wall of a transformer casing, for example. Conductive base 26 is seated in one end of the housing axial passage and comprises a conductive insert equipped with a threaded bore 26*a* or the like for receiving the threaded extension 28 of an electrical cable 30 comprising, for example, a lead-in connection to a winding of such transformer. On engagement thereof, base 26 and a cable extension 28 effectively close one end of the housing passage.

A piston or female contact assembly is disposed in the housing passage for sliding displacement and comprises an electrically conductive piston 32, female contact element 14, a tubular insulative sleeve 34, guide 36 and valve 38. In the illustrated construction of the piston assembly, piston 32 includes a through bore interiorly threaded in part and female contact element 14 is threaded exteriorly for fixed securement in the piston bore. Tubular sleeve 34 is secured, e.g., by an adhesive, to female contact element 14 and in turn encirclingly supports guide 36 through the use of a like adhesive. By this arrangement all elements of the piston or female contact assembly are jointly movable.

Guide 36 is comprised of arc-quenching material, preferably, though not necessarily, the same as that of the follower 12, and functions to receive and guide follower 12 and contact element 10 and to provide mutual alignment of the FIG. 1 apparatus and the housing (not shown) for male contact element 10.

Figure 5:
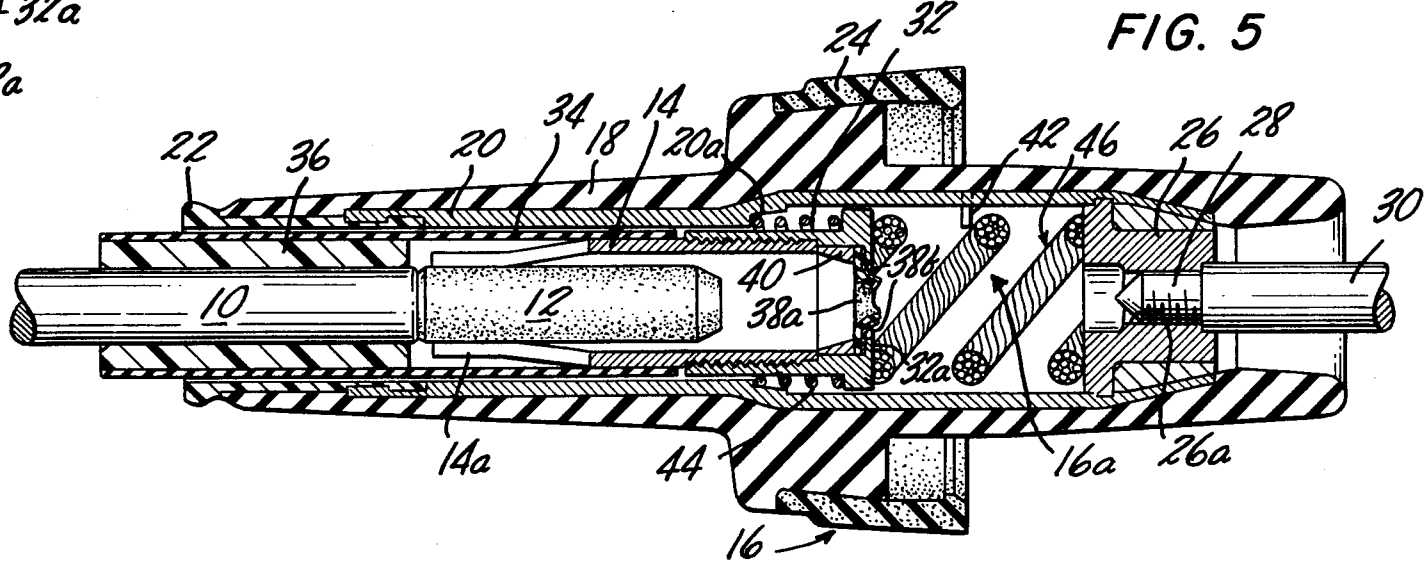
FIG. 5 illustrates the state of the FIG. 1 apparatus during the course of fault closure activity.

Valve 38 is seated in the piston bore against centrally apertured piston wall 32*a* and is held securely in place by ring 40 against which bears one end of contact element 14. One form of valve suitable for use in practicing the invention is shown in FIGS. 1 and 2, the detail thereof being best seen in FIG. 2 wherein rupturable resilient member or disc 38*a* and wire screen 38*b* provide a closed or substantially gas-impermeable structure when the differential in gas pressure thereacross is less than a predetermined gas pressure differential. In response to differential pressure equal to or exceeding such predetermined differential, the valve is ruptured as shown in FIG. 5. As discussed below, such predetermined gas pressure differential is that occurring upon fault closure activity. Screen 38*b* reinforces member 38*a* to avert rupture at gas pressure differentials lower than said predetermined pressure differential.

Pin 42 is supported by housing 16 axially spaced from base 26 and projects into the housing passage for defining a chamber or cavity 16*a* of no lesser axial extent than such spacing.

In the position thereof illustrated in FIG. 1, piston 32 abuts pin 42 under the influence of biasing or resilient means, preferably comprising a compression spring 44. Sleeve 20 includes an expanse of increased diameter defining a shoulder 20*a* for seating one end of the spring. The other end of the spring bears against piston 32. Pin 42 thus functions as a stop or limiting means, preventing displacement of the piston assembly into the above-mentioned axial cavity. Under these conditions, tubular sleeve 34 is disposed in a first position wherein piston 32 is substantially adjacent the end of the housing seating base 26.

The piston assembly defines an axial chamber inclusive of the interior hollows of guide 36, sleeve 34 and female contact element 14, such chamber being isolated from the above-mentioned housing chamber or axial cavity when valve 38 is closed.

Conductors or connectors 46 are disposed in such cavity and the ends of the cable are secured respectively to base 26 and piston 32. Conductors 46 provide electrical continuity of substantially fixed resistivity between piston 32 and base 26 and accordingly between female contact element 14 and cable 30.

Characteristics of the FIG. 1 apparatus other than those elicited in the foregoing discussion will be evident from the following description of the operation of such structure respectively in loadmake, loadbreak, and fault closure activity.

LOADMAKE

With the component parts of the apparatus in position illustrated in FIG. 1, follower 12 is inserted into guide 36. Spring 44 normally maintains sleeve 34 and piston 32 in the above-mentioned first position. With the piston in such easily recognized and certain position and upon abutment between follower 12 and resilient fingers **14*a*, alignment of the male contact element housing with the female contact element housing as well as operator stance may be checked for any necessary correction. Upon continued insertion of follower 12, resilient fingers 14*a* are spread and frictionally engage the follower periphery. In the course of such continued insertion, an arc is struck prior to engagement of fingers 14*a* with contact element 10. Under normal load conditions in the circuit connected to cable 30, the energy of such arc is moderate. During the course of arcing, guide 36 and follower 12 emit arc-quenching gas. The arc may persist at intensity lessened by the quenching gas until fingers 14*a* engage contact element 10. Throughout persistance of the arc, all arcing current flows through a definite electrical path of substantially fixed resistivity between cable 30 and its unshown counterpart cable, such path comprising pin 10, contact element 14, piston 32, cables 46 and base 26. Under such loadmake conditions valve 38 isolates cavity 16*a*** from the piston assembly chamber and is effective to confine arc-quenching gas to the region of the arc.

Figure 3:
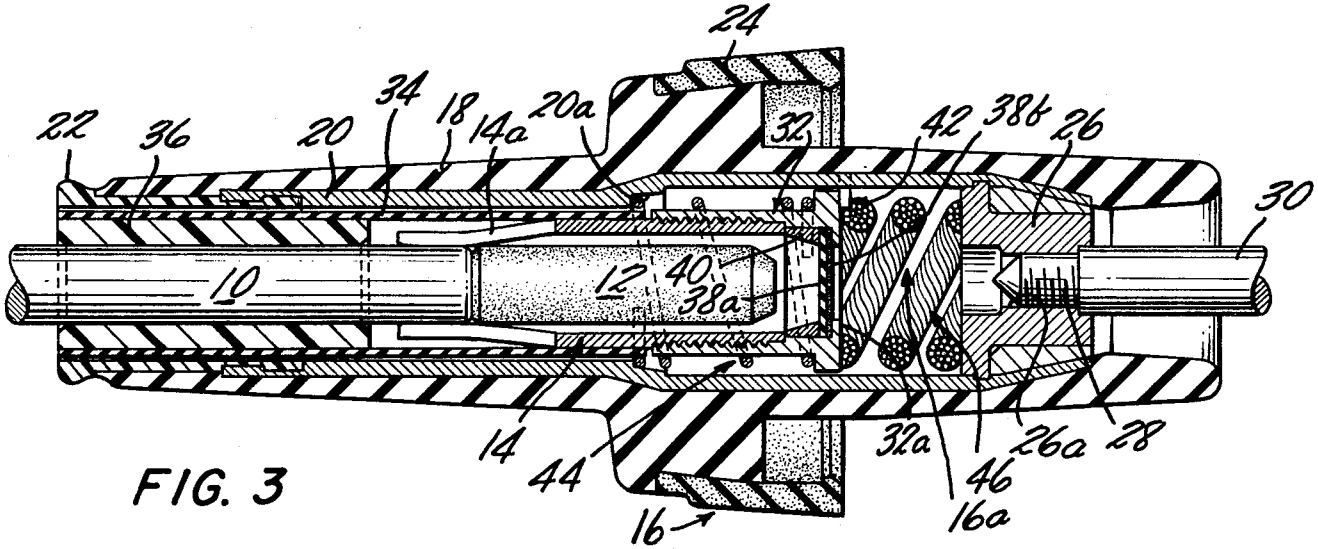
FIG. 3 illustrates the state of the FIG. 1 apparatus in completed loadmake activity.

FIG. 3 shows the connector apparatus on completion of loadmake and in its principal usage, i.e., in energizing a load.

LOADBREAK

Figure 4:
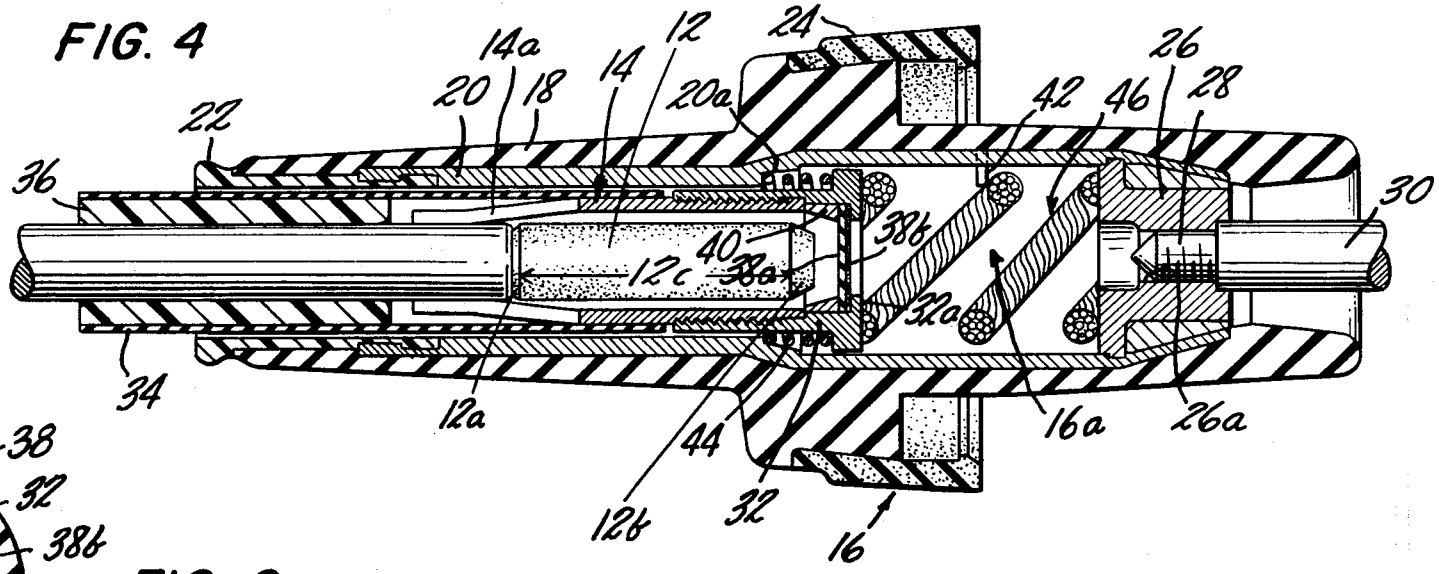
FIG. 4 illustrates the state of the FIG. 1 apparatus immediately prior to loadbreak activity.

In the event it is necessary or desirable to interrupt electrical continuity between contact element 10 and cable 30 while the circuit is energized, element 10 is withdrawn from housing 16. Since contact fingers **14*a* apply a frictional force to element 10 exceeding the force applied by spring 44 to piston 32, the piston assembly is withdrawn jointly with element 10, i.e., sleeve 34, element 14 and element 10 move jointly, up to the point at which shoulder 20*a* and then compressed spring 44 limit piston assembly movement in the direction of withdrawal as shown in FIG. 4. Sleeve 34 is thus in a second position wherein the piston is located between its first position and the end of the housing receiving element 10. At this juncture, element 10 moves relative to the piston assembly and ultimately separates from contact element fingers 14*a* at which time an arc is struck therebetween. Such arc is quenched by gases generated by guide 36 and follower 12 and is ultimately extinguished as the contact elements further separate and the follower thereafter exits from guide 36. Arc extinction is abetted since element 10 not only exits from contact element 14 at substantially the speed of movement imparted thereto by the operator but furthermore since tubular sleeve 34, hence contact element 14, is itself rapidly returned to its normal first position upon disengagement from element 10 and follower 12 under the influence of spring 44, thereby facilitating accelerated separation of these contact elements. Such rapid return preferably commences when the follower 12 is partially withdrawn from female contact element 14. In order to facilitate the foregoing, the pin follower 12 may be slightly tapered along substantially its entire axial extent 12*c* (as shown in FIG. 4), in such a manner that the diameter of the pin follower 12 at its thickest point is slightly larger than the smallest inside diameter defined by the contact fingers 14*a* and tapers to a diameter smaller than the smallest inside diameter defined by the contact fingers 14*a*. Such slight tapering of follower 12 along substantially its entire axial extent 12*c* is in addition to the customary follower sharply chamfered end tapers 12*a* and 12*b* on oppositely disposed ends of follower 12. This slight taper along the entire axial extent 12*c* of follower 12 is important because if follower 12 has the diameter of element 10 and is untapered over its axial extent 12*c* between such end tapers, the above-mentioned frictional force between element 10 and contact fingers 14*a*, preventing spring 44 from moving contact element 14 relative to contact element 10 as discussed above, will likewise exist throughout engagement of contact fingers 14*a* and follower extent 12*c*. Such force would prevent spring 44 from commencing the rapid return of contact element 14 until end taper 12*b* reaches contact fingers 14*a* in which case rapid return of contact element 14 would commence at the time of exit of end taper 12*a* from contact fingers 14*a* and not, as in accordance with one aspect of the invention, when follower 12 is only partially withdrawn from contact element 14. As will be appreciated, in practice under this aspect of the subject invention, accelerated return of female contact element 14 is commenced after disengagement of male contact element 10 from contact element 14 but prior to complete withdrawal of follower 12 including follower end taper 12*b* from contact element 14, i.e., when follower 12 is partially withdrawn from contact element 14**.

Figure 6:
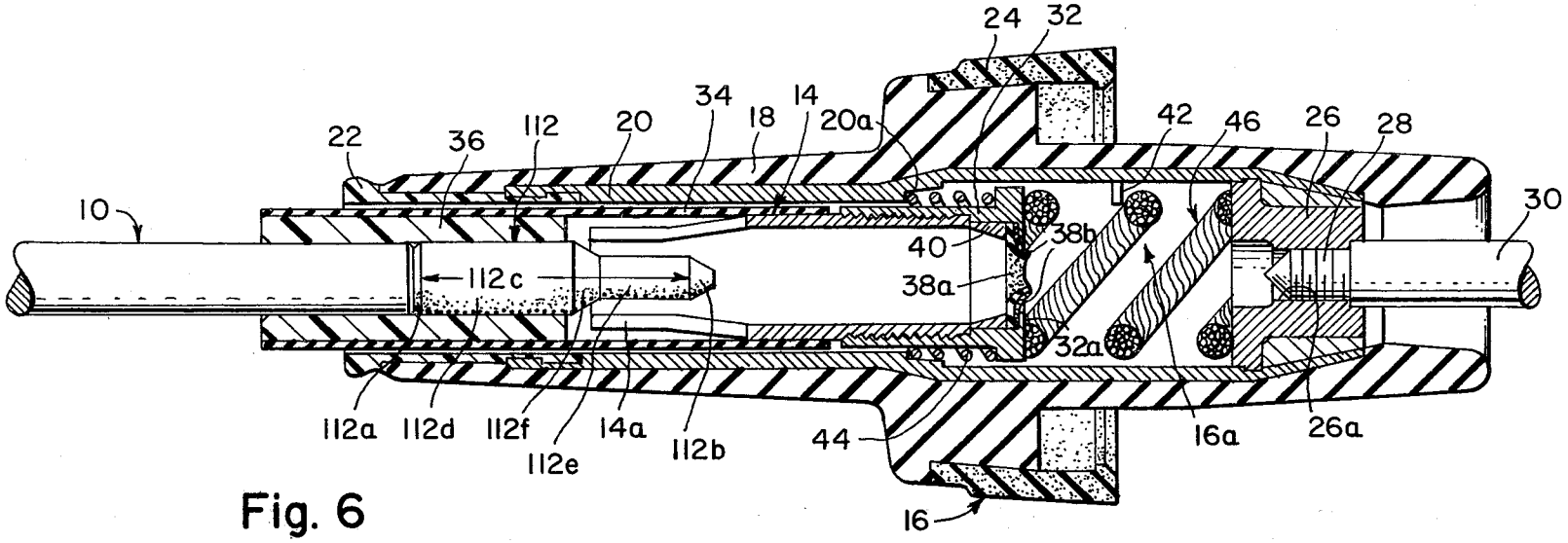
FIG. 6 illustrates a further embodiment of apparatus in accordance with the invention.

It will be appreciated that the accelerated return of female contact element 14 prior to complete withdrawal of element 10 from female contact element 14 may also be accomplished by a follower 112 (FIG. 6) having first and second portions **112*d* and 112*e* of different diameters with the first and second portions being joined by a sharply tapered interconnecting third portion 112*f* located intermediately along the axial extent 112*c* of the follower 112 and spaced from the opposed sharply chamfered ends 112*a* and 112*b* of the follower. The larger diametered first portion 112*d* is positioned adjacent to element 10 and has a diameter slightly larger than the diameter of element 10 whereas the smaller diametered second portion 112*c* has a diameter slightly less than the smallest inside diameter defined by contact fingers 14*a*. The axial length of the larger diametered portion 112*d* of the follower 112 and thus the exact axial location of the tapered interconnection between the larger diametered portion 112*d* and the smaller diametered portion 112*e* is dependent upon the desired point at which accelerated return of contact element 14 is to commence prior to complete withdrawal of element 10 from contact element 14. The foregoing follower construction achieves essentially the same results as the follower shown in FIG. 4 in that there is effected an accelerated return of female contact element 14 upon partial withdrawal of element 10, i.e., when contact fingers 14***a* are caused to slide relative to the follower along its axial extent and reach the general vicinity of the tapered interconnection between the larger diametered first portion 112*d* and the smaller diametered second portion 112*c* of the follower 112. It will be understood that initial joint movement of the contact elements and subsequent relative sliding movement therebetween may occur during withdrawal of the male contact element before spring 44 is fully compressed.

While valve 38 is inoperable during the above-discussed loadbreak situation, its presence nevertheless contributes substantially to the loadbreak performance of a connector assembly having capacity for gas-accelerated contact engagement during fault closure, as will be discussed after the following explanation of fault closure activity.

FAULT CLOSURE

To the extent that an operator is unaware of the existence of a fault condition in a load, he approaches this situation, as in the loadmake situation above-discussed, by inserting follower 12 in guide 36 and checking stance, alignment and like considerations. The follower is then inserted within contact element fingers 14*a* and, as element 10 approaches the fingers, an arc of quite high intensity is struck, producing a shock wave in the piston assembly chamber and thereby creating said predetermined pressure differential across valve 38. Valve 38 is accordingly ruptured. On this event arc-quenching gas passes from the piston assembly chamber, through the ruptured valve and into cavity 16*a* and exerts a net force on piston 32 displacing the same toward element 10 as shown in FIG. 5. Accordingly, contact element fingers 14*a* are accelerated into engagement with element 10, extinguishing the arc.

In providing, in a composite structure, performance capabilities approached separately or in limited groupings in presently-used connector apparatus, the apparatus of the invention gains certain performance benefits. By way of example alluded to above, valve 38, operable exclusively in fault closure activity, abets loadbreak performance although then inoperable. Fundamental to such fault closure activity is the requirement for a housing cavity located on the side of a piston assembly opposite that side thereof toward which the male contact element is advanced. Such cavity constitutes gas-accessible volume additive to that of the piston assembly chamber. In the course of loadbreak, however, such additive gas-accessible volume is undesired since it is believed that the same lessens the vacuum created within the housing upon withdrawal of the male contact element. The level of such created vacuum controls the inrush of air which counteracts arc-generated gas and prevents the same from flushing out between the separated housings and forming an undesirable conductive path to ground. A desired higher vacuum level during load-break in a connector also adapted for fault closure is attained in substantial part by means such as valve 38.

A particularly desired feature which may be introduced in connectors according with the invention for purposes of minimizing arcing and decreasing the gas generated by arcing during fault closure involves the spacing of contact element 14 from guide 36 by an axial length no less than the order of magnitude of one-half the distance between contact elements 10 and 14 at which an arc will be struck between the contact elements as contact element 10 approaches contact element 14 under high voltage fault conditions. Such spacing is indicated in FIG. 1 by the reference designation S.

Various alternative valve constructions may be employed in place of the preferred rupturable valve. Thus, for example, the invention contemplates use of a duckbill flap type of valve which opens upon fault closure and reverts to its substantially gas impermeable initial condition following fault closure activity, i.e., a reclosable valve means.

Various additional changes to the particularly disclosed and illustrated connector apparatus and modifications in the practice outlined above will now be evident to those skilled in the art. The particularly discussed embodiment of connector apparatus according with the invention is accordingly to be considered illustrative and not limiting. The true spirit and scope of the invention is set forth in the following claims.

What is claimed is:

1. A contact assembly separable during energization of a high voltage circuit therethrough, comprising:

a. a housing having an open end and an axial passage extending interiorly from said open end;

b. a male contact assembly axially disposed in said passage and comprising a male contact element and an elongate member supported by said male contact element extending axially therefrom along said passage and evolving arc-quenching gas upon the striking of an arc in said passage, such gas evolving member having a first end joined to said male contact element an opposite end defining an end taper;

c. a female contact assembly in said housing and comprising a female contact element releasably engaging said male contact element and spacedly encircling said gas evolving member during said energization of a high voltage circuit through said contact assembly; and d. said gas evolving member having an axial location of larger diameter axially spaced toward said first end from said end taper and an axial location of smaller diameter between said location of larger diameter and said end taper, thus to facilitate withdrawal of said gas evolving member from said female contact element.

2. The contact assembly claimed in claim 1 wherein said gas evolving member is provided with an axial taper extending between said locations of larger and smaller diameter.

3. The contact assembly claimed in claim 2 wherein said axial taper extends along substantially the entire axial extent of said gas evolving member between said first end and said end taper.

4. The contact assembly claimed in claim 1 wherein said gas evolving member is provided with a first cylindrical portion of said larger diameter extending toward said end taper from said location of larger diameter and a second cylindrical portion of said smaller diameter extending toward said first end from said location of smaller diameter.

5. The contact assembly claimed in claim 4 wherein said location of larger diameter is adjacent said first end and said location of smaller diameter is adjacent said end taper.

6. A contact assembly separable during energization of a high voltage circuit therethrough comprising:

a. a housing having an open end and an axial passage extending interiorly from said open end;

b. a male contact assembly axially disposed in said passage and comprising a male contact element and an elongate member supported by said male contact element extending axially therefrom along said passage and evolving arc-quenching gas upon the striking of an arc in said passage, such gas evolving member having a first end joined to said male contact element an opposite end defining an end taper;

c. a female contact assembly slidably axially displaceable in said passage between a first position and a second position, said first position being axially interior of said second position, said female contact assembly comprising a female contact element releasably engaging said male contact element and spacedly encircling said gas evolving member during said energization of a high voltage circuit through said contact assembly;

d. biasing means between said housing and said female contact assembly for permitting joint movement of said male and female contact assemblies from said first position to said second position during withdrawal of said male contact assembly from said housing open end and for commencing accelerated return of said female contact assembly to said first position after disengagement of said male contact element from said female contact element at said second position but prior to withdrawal of said gas evolving member end taper from said female contact element; and e. said gas evolving member having an axial location of larger diameter axially spaced toward said first end from said end taper and an axial location of smaller diameter between said location of larger diameter and said end taper, thus to facilitate such commencement of said accelerated return of said female contact assembly to said first position.

7. The contact assembly claimed in claim 6 wherein said gas evolving member is provided with an axial taper extending between said locations of larger and smaller diameter.

8. The contact assembly claimed in claim 7 wherein said axial taper extends along substantially the entire axial extent of said gas evolving member between said first end and said end taper.

9. The contact assembly claimed in claim 6 wherein said gas evolving member is provided with a first cylindrical portion of said larger diameter extending toward said end taper from said location of larger diameter and a second cylindrical portion of said smaller diameter extending toward said first end from said location of smaller diameter.

10. The contact assembly claimed in claim 9 wherein said location of larger diameter is adjacent said first end and said location of smaller diameter is adjacent said end taper.

* * * * *

UNITED STATES PATENT AND TRADEMARK OFFICE

CERTIFICATE OF CORRECTION

PATENT NO. : 4,068,913

DATED : January 17, 1978

INVENTOR(S) : Robert J. Stanger and Larry N. Siebens

It is certified that error appears in the above-identified patent and that said Letters Patent are hereby corrected as shown below:

Column 8, line 32, between "element" and "an" (first occurrence) insert --and--; and
Column 9, line 10, between "element" and "an" (first occurrence) insert --and--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*